US010071575B2

(12) United States Patent
Lim et al.

(10) Patent No.: US 10,071,575 B2
(45) **Date of Patent: *Sep. 11, 2018**

(54) PRINTERS AND METHODS FOR DETECTING PRINT MEDIA THICKNESS THEREIN

(71) Applicant: Datamax-O'Neil Corporation, Orlando, FL (US)

(72) Inventors: Boon Kheng Lim, Singapore (SG); Aravindkumar Harinarayanan, Singapore (SG); Danny Lim, Singapore (SG)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/795,353

(22) Filed: Oct. 27, 2017

(65) Prior Publication Data

US 2018/0201035 A1 Jul. 19, 2018

Related U.S. Application Data

(63) Continuation of application No. 15/408,572, filed on Jan. 18, 2017, now Pat. No. 9,802,427.

(51) Int. Cl.
*B41J 11/00* (2006.01)
*B41J 13/00* (2006.01)

(52) U.S. Cl.
CPC ..... *B41J 13/0009* (2013.01); *B41J 11/0095* (2013.01); *B41J 11/0035* (2013.01)

(58) Field of Classification Search
CPC ..... G01B 5/02; G01B 5/06; B41J 11/0035; B41J 11/0095
See application file for complete search history.

(56) References Cited

U.S. PATENT DOCUMENTS 5,137,377 A 8/1992 Ito et al.
5,445,458 A 8/1995 Uchiyama
(Continued)

FOREIGN PATENT DOCUMENTS

FR 2685650 * 7/1993 ..... G01B 11/06
GB 1506232 * 4/1978 ..... G01B 7/06
(Continued)

*Primary Examiner* — Huan Tran
(74) *Attorney, Agent, or Firm* — Additon, Higgins & Pendleton, P.A.

(57) ABSTRACT

Printer is provided having support base on which print media travels. Printer includes thickness detection module and processor. Thickness detection module includes pinch arm assembly with pinch arm having first and second ends, encoder, and proximate dual channel encoder sensor. First end is biased toward support base. Encoder with number of circumferentially spaced line pairs is disposed at second end. Pinch arm and encoder configured to rotate in response to engagement of pinch arm with at least print media portion. Dual channel encoder sensor configured to detect rotation direction and encoder count and output signal representing encoder count. Encoder count is number of circumferentially spaced line pairs that pass by dual channel encoder sensor as pinch arm and encoder rotate. Processor is communicatively coupled to dual channel encoder sensor and configured to receive signal and calculate print media thickness of portion from encoder count using conversion factor.

19 Claims, 7 Drawing Sheets

(56) References Cited

U.S. PATENT DOCUMENTS 5,806,992 A 9/1998 Ju
6,734,417 B2 * 5/2004 Vejtasa ..... B65H 7/12 209/604
6,832,725 B2 12/2004 Gardiner et al.
6,850,717 B2 2/2005 Fujikura et al.
7,128,266 B2 10/2006 Zhu et al.
7,159,783 B2 1/2007 Walczyk et al.
7,413,127 B2 8/2008 Ehrhart et al.
7,693,802 B2 * 4/2010 Defosse ..... G01B 11/0691 705/407
7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,732,971 B2 * 5/2014 Wu ..... G01B 5/06 33/501.02
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.

(56) References Cited

U.S. PATENT DOCUMENTS 8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,061,527 B2 6/2015 Tobin et al.
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,076,459 B2 7/2015 Braho et al.
9,079,423 B2 7/2015 Bouverie et al.
9,080,856 B2 7/2015 Laffargue
9,082,023 B2 7/2015 Feng et al.
9,084,032 B2 7/2015 Rautiola et al.
9,087,250 B2 7/2015 Coyle
9,092,681 B2 7/2015 Havens et al.
9,092,682 B2 7/2015 Wilz et al.
9,092,683 B2 7/2015 Koziol et al.
9,093,141 B2 7/2015 Liu
9,098,763 B2 8/2015 Lu et al.
9,104,929 B2 8/2015 Todeschini
9,104,934 B2 8/2015 Li et al.
9,107,484 B2 8/2015 Chaney
9,111,159 B2 8/2015 Liu et al.
9,111,166 B2 8/2015 Cunningham
9,135,483 B2 9/2015 Liu et al.
9,137,009 B1 9/2015 Gardiner
9,141,839 B2 9/2015 Xian et al.
9,147,096 B2 9/2015 Wang
9,148,474 B2 9/2015 Skvoretz
9,158,000 B2 10/2015 Sauerwein
9,158,340 B2 10/2015 Reed et al.
9,158,953 B2 10/2015 Gillet et al.
9,159,059 B2 10/2015 Daddabbo et al.
9,165,174 B2 10/2015 Huck
9,171,543 B2 10/2015 Emerick et al.
9,183,425 B2 11/2015 Wang
9,189,669 B2 11/2015 Zhu et al.
9,195,844 B2 11/2015 Todeschini et al.
9,202,458 B2 12/2015 Braho et al.
9,208,366 B2 12/2015 Liu
9,208,367 B2 12/2015 Wang
9,219,836 B2 12/2015 Bouverie et al.
9,224,022 B2 12/2015 Ackley et al.
9,224,024 B2 12/2015 Bremer et al.
9,224,027 B2 12/2015 Van Horn et al.
D747,321 S 1/2016 London et al.
9,230,140 B1 1/2016 Ackley
9,235,553 B2 1/2016 Fitch et al.
9,239,950 B2 1/2016 Fletcher
9,245,492 B2 1/2016 Ackley et al.
9,443,123 B2 1/2016 Hejl
9,248,640 B2 2/2016 Heng
9,250,652 B2 2/2016 London et al.
9,250,712 B1 2/2016 Todeschini
9,251,411 B2 2/2016 Todeschini
9,258,033 B2 2/2016 Showering
9,262,633 B1 2/2016 Todeschini et al.
9,262,660 B2 2/2016 Lu et al.
9,262,662 B2 2/2016 Chen et al.
9,269,036 B2 2/2016 Bremer
9,270,782 B2 2/2016 Hala et al.
9,274,812 B2 3/2016 Doren et al.
9,275,388 B2 3/2016 Havens et al.
9,277,668 B2 3/2016 Feng et al.
9,280,693 B2 3/2016 Feng et al.
9,286,496 B2 3/2016 Smith
9,297,900 B2 3/2016 Jiang
9,298,964 B2 3/2016 Li et al.
9,301,427 B2 3/2016 Feng et al.
9,304,376 B2 4/2016 Anderson
9,310,609 B2 4/2016 Rueblinger et al.
9,313,377 B2 4/2016 Todeschini et al.
9,317,037 B2 4/2016 Byford et al.
D757,009 S 5/2016 Oberpriller et al.
9,342,723 B2 5/2016 Liu et al.
9,342,724 B2 5/2016 McCloskey
9,360,304 B2 6/2016 Xue et al.
9,361,882 B2 6/2016 Ressler et al.
9,365,381 B2 6/2016 Colonel et al.
9,373,018 B2 6/2016 Colavito et al.
9,375,945 B1 6/2016 Bowles
9,378,403 B2 6/2016 Wang et al.
D760,719 S 7/2016 Zhou et al.
9,383,848 B2 7/2016 Daghigh
9,384,374 B2 7/2016 Bianconi
9,390,596 B1 7/2016 Todeschini
D762,604 S 8/2016 Fitch et al.
9,411,386 B2 8/2016 Sauerwein
9,412,242 B2 8/2016 Van Horn et al.
9,418,269 B2 8/2016 Havens et al.
9,418,270 B2 8/2016 Van Volkinburg et al.
9,423,318 B2 8/2016 Lui et al.
D766,244 S 9/2016 Zhou et al.
9,443,222 B2 9/2016 Singel et al.
9,454,689 B2 9/2016 McCloskey et al.
9,464,885 B2 10/2016 Lloyd et al.

(56) References Cited

U.S. PATENT DOCUMENTS 9,465,967 B2 10/2016 Xian et al.
9,478,113 B2 10/2016 Xie et al.
9,478,983 B2 10/2016 Kather et al.
D771,631 S 11/2016 Fitch et al.
9,481,186 B2 11/2016 Bouverie et al.
9,488,986 B1 11/2016 Solanki
9,489,782 B2 11/2016 Payne et al.
9,490,540 B1 11/2016 Davies et al.
9,491,729 B2 11/2016 Rautiola et al.
9,497,092 B2 11/2016 Gomez et al.
9,507,974 B1 11/2016 Todeschini
9,519,814 B2 12/2016 Cudzilo
9,521,331 B2 12/2016 Bessettes et al.
9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
9,802,427 B1 * 10/2017 Lim ..... B41J 13/0009
2003/0099494 A1 5/2003 Downing
2004/0151418 A1 * 8/2004 Hall ..... B41J 11/0035 385/13
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2012/0327153 A1 12/2012 Bouverie et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.

(56) References Cited

U.S. PATENT DOCUMENTS

| | | | |
|---|---|---|---|
| 2015/0128116 | A1 | 5/2015 | Chen et al. |
| 2015/0133047 | A1 | 5/2015 | Smith et al. |
| 2015/0134470 | A1 | 5/2015 | Hejl et al. |
| 2015/0136851 | A1 | 5/2015 | Harding et al. |
| 2015/0142492 | A1 | 5/2015 | Kumar |
| 2015/0144692 | A1 | 5/2015 | Hejl |
| 2015/0144698 | A1 | 5/2015 | Teng et al. |
| 2015/0149946 | A1 | 5/2015 | Benos et al. |
| 2015/0161429 | A1 | 6/2015 | Xian |
| 2015/0186703 | A1 | 7/2015 | Chen et al. |
| 2015/0199957 | A1 | 7/2015 | Funyak et al. |
| 2015/0210199 | A1 | 7/2015 | Payne |
| 2015/0220753 | A1 | 8/2015 | Zhu et al. |
| 2015/0254485 | A1 | 9/2015 | Feng et al. |
| 2015/0310243 | A1 | 10/2015 | Ackley |
| 2015/0310389 | A1 | 10/2015 | Crimm et al. |
| 2015/0327012 | A1 | 11/2015 | Bian et al. |
| 2016/0014251 | A1 | 1/2016 | Hejl |
| 2016/0040982 | A1 | 2/2016 | Li et al. |
| 2016/0042241 | A1 | 2/2016 | Todeschini |
| 2016/0057230 | A1 | 2/2016 | Todeschini et al. |
| 2016/0062473 | A1 | 3/2016 | Bouchat et al. |
| 2016/0092805 | A1 | 3/2016 | Geisler et al. |
| 2016/0101936 | A1 | 4/2016 | Chamberlin |
| 2016/0102975 | A1 | 4/2016 | McCloskey et al. |
| 2016/0104019 | A1 | 4/2016 | Todeschini et al. |
| 2016/0104274 | A1 | 4/2016 | Jovanovski et al. |
| 2016/0109219 | A1 | 4/2016 | Ackley et al. |
| 2016/0109220 | A1 | 4/2016 | Laffargue |
| 2016/0109224 | A1 | 4/2016 | Thuries et al. |
| 2016/0112631 | A1 | 4/2016 | Ackley et al. |
| 2016/0112643 | A1 | 4/2016 | Laffargue et al. |
| 2016/0117627 | A1 | 4/2016 | Raj et al. |
| 2016/0124516 | A1 | 5/2016 | Schoon et al. |
| 2016/0125217 | A1 | 5/2016 | Todeschini |
| 2016/0125342 | A1 | 5/2016 | Miller et al. |
| 2016/0133253 | A1 | 5/2016 | Braho et al. |
| 2016/0171597 | A1 | 6/2016 | Todeschini |
| 2016/0171666 | A1 | 6/2016 | McCloskey |
| 2016/0171720 | A1 | 6/2016 | Todeschini |
| 2016/0171775 | A1 | 6/2016 | Todeschini et al. |
| 2016/0171777 | A1 | 6/2016 | Todeschini et al. |
| 2016/0174674 | A1 | 6/2016 | Oberpriller et al. |
| 2016/0178479 | A1 | 6/2016 | Goldsmith |
| 2016/0178685 | A1 | 6/2016 | Young et al. |
| 2016/0178707 | A1 | 6/2016 | Young et al. |
| 2016/0179132 | A1 | 6/2016 | Harr et al. |
| 2016/0179143 | A1 | 6/2016 | Bidwell et al. |
| 2016/0179368 | A1 | 6/2016 | Roeder |
| 2016/0179378 | A1 | 6/2016 | Kent et al. |
| 2016/0180130 | A1 | 6/2016 | Bremer |
| 2016/0180133 | A1 | 6/2016 | Oberpriller et al. |
| 2016/0180136 | A1 | 6/2016 | Meier et al. |
| 2016/0180594 | A1 | 6/2016 | Todeschini |
| 2016/0180663 | A1 | 6/2016 | McMahan et al. |
| 2016/0180678 | A1 | 6/2016 | Ackley et al. |
| 2016/0180713 | A1 | 6/2016 | Bernhardt et al. |
| 2016/0185136 | A1 | 6/2016 | Ng et al. |
| 2016/0185291 | A1 | 6/2016 | Chamberlin |
| 2016/0186926 | A1 | 6/2016 | Oberpriller et al. |
| 2016/0188861 | A1 | 6/2016 | Todeschini |
| 2016/0188939 | A1 | 6/2016 | Sailors et al. |
| 2016/0188940 | A1 | 6/2016 | Lu et al. |
| 2016/0188941 | A1 | 6/2016 | Todeschini et al. |
| 2016/0188942 | A1 | 6/2016 | Good et al. |
| 2016/0188943 | A1 | 6/2016 | Linwood |
| 2016/0188944 | A1 | 6/2016 | Wilz et al. |
| 2016/0189076 | A1 | 6/2016 | Mellott et al. |
| 2016/0189087 | A1 | 6/2016 | Morton et al. |
| 2016/0189088 | A1 | 6/2016 | Pecorari et al. |
| 2016/0189092 | A1 | 6/2016 | George et al. |
| 2016/0189284 | A1 | 6/2016 | Mellott et al. |
| 2016/0189288 | A1 | 6/2016 | Todeschini |
| 2016/0189366 | A1 | 6/2016 | Chamberlin et al. |
| 2016/0189443 | A1 | 6/2016 | Smith |
| 2016/0189447 | A1 | 6/2016 | Valenzuela |
| 2016/0189489 | A1 | 6/2016 | Au et al. |
| 2016/0191684 | A1 | 6/2016 | DiPiazza et al. |
| 2016/0192051 | A1 | 6/2016 | DiPiazza et al. |
| 2016/0125873 | A1 | 7/2016 | Braho et al. |
| 2016/0202951 | A1 | 7/2016 | Pike et al. |
| 2016/0202958 | A1 | 7/2016 | Zabel et al. |
| 2016/0202959 | A1 | 7/2016 | Doubleday et al. |
| 2016/0203021 | A1 | 7/2016 | Pike et al. |
| 2016/0203429 | A1 | 7/2016 | Mellott et al. |
| 2016/0203797 | A1 | 7/2016 | Pike et al. |
| 2016/0203820 | A1 | 7/2016 | Zabel et al. |
| 2016/0204623 | A1 | 7/2016 | Haggerty et al. |
| 2016/0204636 | A1 | 7/2016 | Allen et al. |
| 2016/0204638 | A1 | 7/2016 | Miraglia et al. |
| 2016/0316190 | A1 | 7/2016 | McCloskey et al. |
| 2016/0227912 | A1 | 8/2016 | Oberpriller et al. |
| 2016/0232891 | A1 | 8/2016 | Pecorari |
| 2016/0292477 | A1 | 10/2016 | Bidwell |
| 2016/0294779 | A1 | 10/2016 | Yeakley et al. |
| 2016/0306769 | A1 | 10/2016 | Kohtz et al. |
| 2016/0314276 | A1 | 10/2016 | Sewell et al. |
| 2016/0314294 | A1 | 10/2016 | Kubler et al. |
| 2016/0323310 | A1 | 11/2016 | Todeschini et al. |
| 2016/0325677 | A1 | 11/2016 | Fitch et al. |
| 2016/0327614 | A1 | 11/2016 | Young et al. |
| 2016/0327930 | A1 | 11/2016 | Charpentier et al. |
| 2016/0328762 | A1 | 11/2016 | Pape |
| 2016/0330218 | A1 | 11/2016 | Hussey et al. |
| 2016/0343163 | A1 | 11/2016 | Venkatesha et al. |
| 2016/0343176 | A1 | 11/2016 | Ackley |
| 2016/0364914 | A1 | 12/2016 | Todeschini |
| 2016/0370220 | A1 | 12/2016 | Ackley et al. |
| 2016/0372282 | A1 | 12/2016 | Bandringa |
| 2016/0373847 | A1 | 12/2016 | Vargo et al. |
| 2016/0377414 | A1 | 12/2016 | Thuries et al. |
| 2016/0377417 | A1 | 12/2016 | Jovanovski et al. |
| 2017/0010141 | A1 | 1/2017 | Ackley |
| 2017/0010328 | A1 | 1/2017 | Mullen et al. |
| 2017/0010780 | A1 | 1/2017 | Waldron, Jr. et al. |
| 2017/0016714 | A1 | 1/2017 | Laffargue et al. |
| 2017/0018094 | A1 | 1/2017 | Todeschini |
| 2017/0046603 | A1 | 2/2017 | Lee et al. |
| 2017/0047864 | A1 | 2/2017 | Stang et al. |
| 2017/0053146 | A1 | 2/2017 | Liu et al. |
| 2017/0053147 | A1 | 2/2017 | Germaine et al. |
| 2017/0053647 | A1 | 2/2017 | Nichols et al. |
| 2017/0055606 | A1 | 3/2017 | Xu et al. |
| 2017/0060316 | A1 | 3/2017 | Larson |
| 2017/0061961 | A1 | 3/2017 | Nichols et al. |
| 2017/0064634 | A1 | 3/2017 | Van Horn et al. |
| 2017/0083730 | A1 | 3/2017 | Feng et al. |
| 2017/0091502 | A1 | 3/2017 | Furlong et al. |
| 2017/0091706 | A1 | 3/2017 | Lloyd et al. |
| 2017/0091741 | A1 | 3/2017 | Todeschini |
| 2017/0091904 | A1 | 3/2017 | Ventress |
| 2017/0092908 | A1 | 3/2017 | Chaney |
| 2017/0094238 | A1 | 3/2017 | Germaine et al. |
| 2017/0098947 | A1 | 4/2017 | Wolski |
| 2017/0100949 | A1 | 4/2017 | Celinder et al. |
| 2017/0108838 | A1 | 4/2017 | Todeschini et al. |
| 2017/0108895 | A1 | 4/2017 | Chamberlin et al. |
| 2017/0118355 | A1 | 4/2017 | Wong et al. |
| 2017/0123598 | A1 | 5/2017 | Phan et al. |
| 2017/0124369 | A1 | 5/2017 | Rueblinger et al. |
| 2017/0124396 | A1 | 5/2017 | Todeschini et al. |
| 2017/0124687 | A1 | 5/2017 | McCloskey et al. |
| 2017/0126873 | A1 | 5/2017 | McGary et al. |
| 2017/0126904 | A1 | 5/2017 | d'Armancourt et al. |
| 2017/0139012 | A1 | 5/2017 | Smith |
| 2017/0140329 | A1 | 5/2017 | Bernhardt et al. |
| 2017/0140731 | A1 | 5/2017 | Smith |
| 2017/0147847 | A1 | 5/2017 | Berggren et al. |
| 2017/0150124 | A1 | 5/2017 | Thuries |
| 2017/0169198 | A1 | 6/2017 | Nichols |
| 2017/0171035 | A1 | 6/2017 | Lu et al. |
| 2017/0171703 | A1 | 6/2017 | Maheswaranathan |
| 2017/0171803 | A1 | 6/2017 | Maheswaranathan |
| 2017/0180359 | A1 | 6/2017 | Wolski et al. |

(56) References Cited

U.S. PATENT DOCUMENTS

| | | | |
|---|---|---|---|
| 2017/0180577 | A1 | 6/2017 | Nguon et al. |
| 2017/0181299 | A1 | 6/2017 | Shi et al. |
| 2017/0190192 | A1 | 7/2017 | Delario et al. |
| 2017/0193432 | A1 | 7/2017 | Bernhardt |
| 2017/0193461 | A1 | 7/2017 | Jonas et al. |
| 2017/0193727 | A1 | 7/2017 | Van Horn et al. |
| 2017/0200108 | A1 | 7/2017 | Au et al. |
| 2017/0200275 | A1 | 7/2017 | McCloskey et al. |

FOREIGN PATENT DOCUMENTS

| | | | |
|---|---|---|---|
| JP | 1-220166 | A | 9/1989 |
| WO | 2013163789 | A1 | 11/2013 |

* cited by examiner

PRINTERS AND METHODS FOR DETECTING PRINT MEDIA THICKNESS THEREIN

CROSS-REFERENCE TO RELATED APPLICATION

The present application claims the benefit of U.S. patent application Ser. No. 15/408,572 for Printers and Methods for Detecting Print Media Thickness Therein filed Jan. 18, 2017, now U.S. Pat. No. 9,802,427. Each of the foregoing patent application and patent is hereby incorporated by reference in its entirety.

FIELD OF THE INVENTION

The present invention relates to printers and methods for detecting print media thickness therein.

BACKGROUND

A thermal transfer printer conventionally includes a thermal print head utilized to thermally transfer a portion of ink from an ink ribbon to print media such as paper, labels, tickets, etc. as the ink ribbon is unwound. The thermal print head presses against the print media to thermally transfer the ink portion thereto.

The pressure of the thermal print head against the print media affects print registration and print quality. The correct pressure depends upon the thickness of the print media. Thermal print head pressure may be set by the user and the setting may not be optimum or correct for the thickness of the print media, resulting in unsatisfactory print registration and print quality.

Therefore, a need exists for systems and methods for detecting a print media thickness of print media in a printer, to provide for an optimal thermal pressure head (TPH) pressure on the print media having the detected print media thickness.

SUMMARY

Printer is provided having support base on which print media travels, according to various embodiments. Printer includes thickness detection module and processor. Thickness detection module includes pinch arm assembly with pinch arm having first and second ends, encoder, and proximate dual channel encoder sensor. First end is biased toward support base. Encoder with number of circumferentially spaced line pairs is disposed at second end. Pinch arm and encoder configured to rotate in response to engagement of pinch arm with at least print media portion. Dual channel encoder sensor configured to detect rotation direction and encoder count and output signal representing encoder count. Encoder count is number of circumferentially spaced line pairs that pass by dual channel encoder sensor as pinch arm and encoder rotate. Processor is communicatively coupled to dual channel encoder sensor and configured to receive signal and calculate print media thickness of portion from encoder count using conversion factor.

A method for detecting the thickness of print media in a printer is provided, according to various embodiments. The method comprises setting an encoder count to zero in response to receiving a no print media sensor signal, receiving a signal from a dual channel encoder sensor proximate an encoder disposed at an end of a pinch arm, and in response to receiving the signal, calculating the print media thickness of the print media from the encoder count using a conversion factor. The encoder has a number of circumferentially spaced line pairs. The signal represents a rotation direction and the encoder count comprising the number of circumferentially spaced line pairs that, during a time interval, pass by the dual channel encoder sensor as the pinch arm and encoder rotate in the rotation direction.

An assembly configured to detect a print media thickness in a printer is provided, according to various embodiments. The assembly comprises a pinch arm having a first end and a second end, an encoder disposed at the second end of the pinch arm, a dual channel encoder sensor proximate the encoder; and a biasing element for urging the pinch arm into engagement with at least a portion of the print media. The encoder has a number of circumferentially spaced line pairs. The pinch arm and encoder are configured to rotate in response to engagement of the pinch arm with at least the portion of the print media.

The foregoing illustrative summary, as well as other exemplary objectives and/or advantages of the invention, and the manner in which the same are accomplished, are further explained within the following detailed description and its accompanying drawings.

DETAILED DESCRIPTION

Various embodiments are directed to printers and systems and methods for detecting a print media thickness of print media in a printer. Various embodiments permit an automatic thermal print head (TPH) pressure adjustment depending on the detected print media thickness, thereby improving print registration and print quality.

As used herein, the term "printer" refers to a device that prints text, barcodes and other information-bearing indicia, illustrations, etc. onto print media (e.g., labels, tickets, plain paper, receipt paper, plastic transparencies, and the like). Various embodiments of the present invention will be described in relation to a thermal transfer printer that uses an ink ribbon to supply media (e.g., ink) and a thermal print head that thermally transfers a portion of the ink from the ink ribbon onto the print media as the ink ribbon is unwound. However, the present invention may be equally applicable to other types and styles of printers that may benefit from detecting the print media thickness. As noted previously, the thermal print head (TPH) pressure as it thermally transfers the portion of the ink from the ink ribbon onto the print media affects print registration and print quality.

Figure 1:
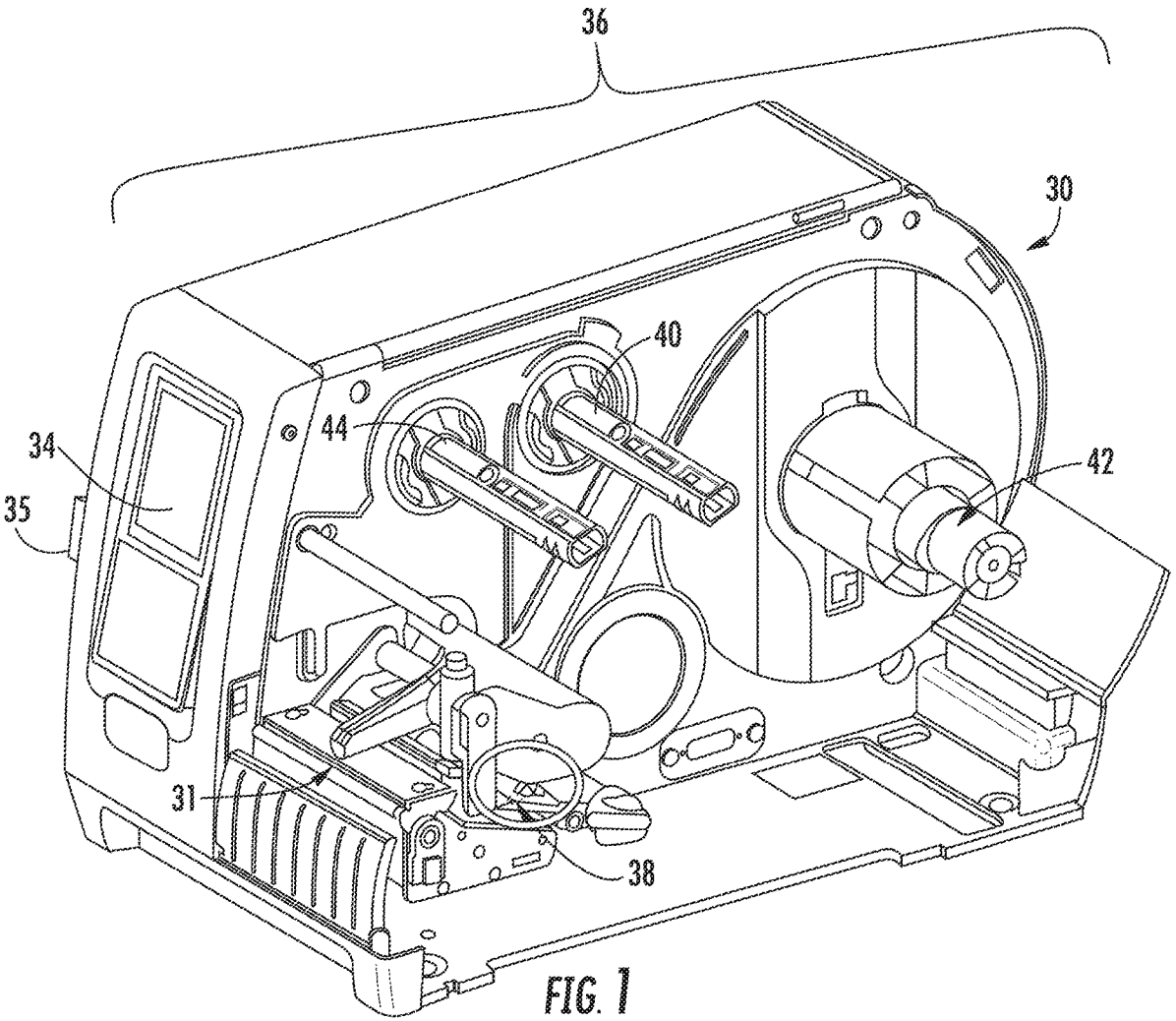
FIG. 1 graphically illustrates a portion of an exemplary printer that may be used in a method for detecting a print media thickness according to various embodiments, a cover of the printer removed to illustrate a print control assembly and a thickness detection module (the encircled region) of the printer according to various embodiments.

Now referring to FIG. 1, according to various embodiments, an exemplary printer 30 capable of printing on print media 22 is partially shown. The depicted printer 30 has a body 32 including a user interface 34 for communication between a user and the printer 30, a processor 35, a print control assembly 36, a power source, and a moveable cover (removed in FIG. 1 for purposes of illustration) for accessing, for example, the interior of the body 32 and the components contained therein. While the illustrated print control assembly 36 is contained within the body 32 of the printer 30, it is to be understood that the print control assembly 36 may be external of the printer. Still referring to FIG. 1, and now briefly to FIGS. 2 through 3, according to various embodiments, the printer 30 further comprises a thickness detection module 38 (encircled region in FIG. 1) contained within the body 32. The printer 30 may have other components as known in the art, such as a print slot from which the printed media exits from the printer 30, and a cutting assembly for assisting in the cutting or separation of the printed medium from non-continuous print media.

Still referring to FIG. 1, the user interface 34 may include, but is not limited to, a display for displaying information, a keypad for entering data, and function buttons that may be configured to perform various typical printing functions (e.g., cancel print job, advance print media, and the like) or be programmable for the execution of macros containing preset printing parameters for a particular type of print media. Additionally, the user interface 34 may be operationally/communicatively coupled to the processor (CPU) 35 for controlling the operation of the printer 30, in addition to other functions discussed below in greater detail. The user interface 34 may be supplemented by or replaced by other forms of data entry or printer control such as a separate data entry and control module linked wirelessly or by a data cable operationally coupled to a computer, a router, or the like.

As known in the art, the central processing unit (CPU) (i.e., the processor 35) is the electronic circuitry within a computer that carries out the instructions of a computer program by performing the basic arithmetic, logical, control and input/output (I/O) operations specified by the instructions as hereinafter described. According to various embodiments, the processor 35 is configured by a software program to perform the steps as hereinafter described. In accordance with various embodiments as hereinafter described, the processor 35 is configured, by the software program, to prompt a user to remove the print media from the printer, set an encoder count to zero after the print media has been removed from the printer, receive a signal representing rotation direction and encoder count, and calculate a print media thickness from the encoder count.

Figure 2:
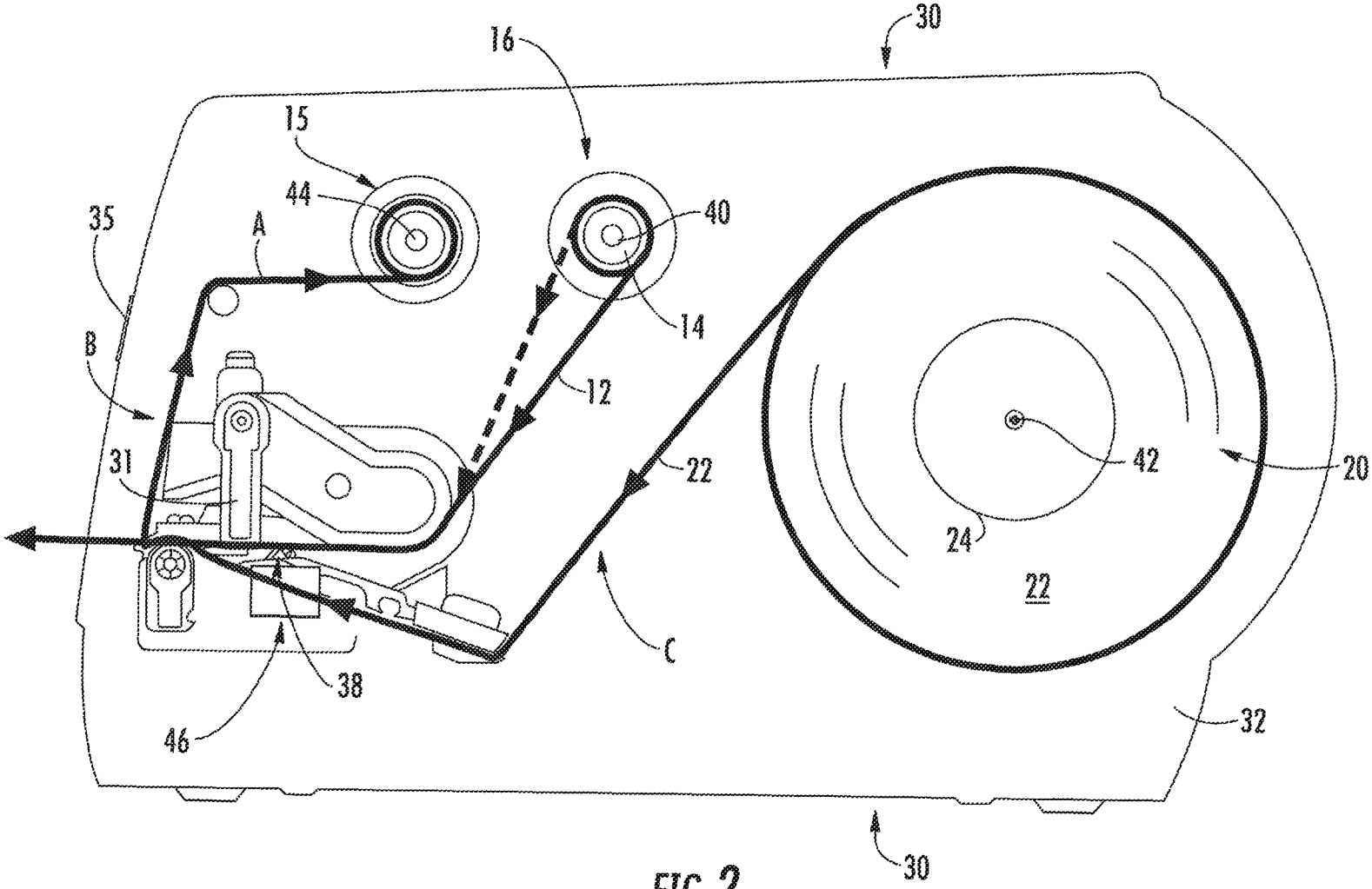
FIG. 2 graphically illustrates an exemplary ribbon path B of an ink ribbon and a media path C of the print media used in the printer of FIG. 1, according to various embodiments.
Figure 3:
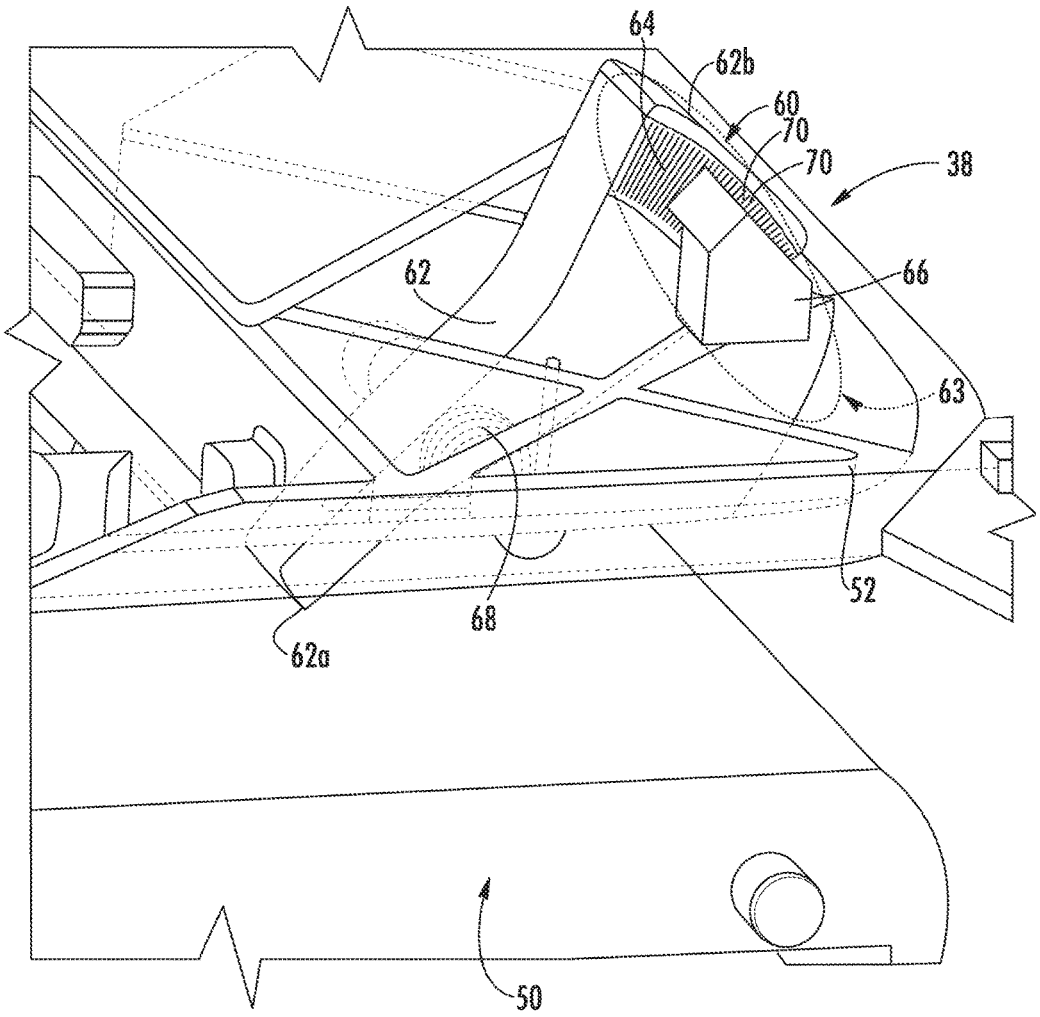
FIG. 3 schematically depicts components of the thickness detection module of the exemplary printer of FIG. 1, illustrating a pinch arm assembly located above a support base in the thickness detection module, the pinch arm assembly comprising a pinch arm attached to an encoder proximate a dual channel encoder sensor and a biasing element mounted to a bracket above the support base for urging a print media engagement end of the pinch arm toward the support base, according to various embodiments.

Still referring to FIG. 1 and again to FIG. 2, according to various embodiments, the print control assembly 36 comprises a ribbon supply spindle 40 on which a ribbon roll 16 is configured to be disposed, a media supply spindle 42 on which a media roll 20 (FIG. 2) is configured to be disposed, and a ribbon rewind spindle 44 on which unwound ribbon is wound up. The ribbon roll 16 comprises ink ribbon 12 continuously wound up on a ribbon core 14 that may be, for example, a cardboard tube. As used herein, the ink ribbon 12 may be of various types, including different widths, lengths, thicknesses, ink colors, ribbon materials, and so forth. The ribbon roll 16 is configured to rotate in a forward or a backward rotational direction, depending on the winding type as depicted in FIG. 2. An empty ribbon take 15 may be disposed on the ribbon rewind spindle 44 although the empty ribbon take 15 (e.g., empty ribbon take 15 on the left in FIG. 2) on the ribbon rewind spindle 44 may not be necessary.

Figure 7A:
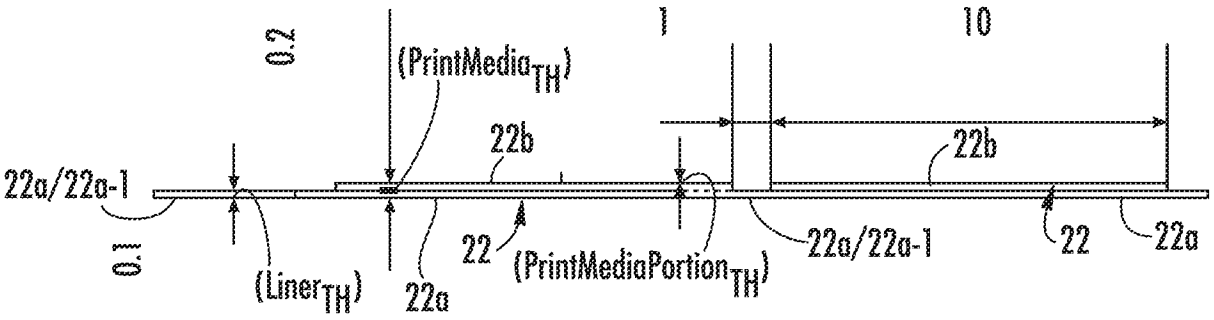
FIGS. 7A and 7B graphically depict the print media 22 of FIGS. 5A through 6B and conversion of an encoder count to print media thickness using an exemplary conversion factor comprising an encoder count of 5 equal to a print media thickness of 0.1 mm, with the encoder count being zero when there is no print media in the printer, the encoder count being 5 when the print media engagement end engages with the liner only portion of the print media (FIGS. 5A and 6B) making the liner 0.1 mm thick ($liner_{Th}$), the encoder count being 15 when the print media engagement end engages with the thick print media (the print medium portion and the underlying liner) (FIGS. 5B and 6A) making the thick print media 0.3 mm thick (Th) and the print medium portion 0.2 mm thick (0.3 mm minus 0.1 mm), according to various embodiments.

The media roll 20 comprises print media 22 wound on a media core 24. As noted previously, the print media 22 may comprise labels, tickets, plain paper, receipt paper, plastic transparencies, and the like. The print media may be continuous or non-continuous. Non-continuous print media 22 may comprise a liner portion 22*a* underlying a plurality of individual print medium 22*b* (a print medium portion) (e.g., a label) to define a liner only portion 22*a*-1 between each of the individual print medium 22*b*. As shown in FIG. 7A, the liner only portion 22*a*/22*a*-1 of the print media 22 and the print media each have a different print media thickness (Print media$_{Th}$). The print media thickness is detected by methods for detecting print media thickness accordance to various embodiments of the present invention as described herein, such that the thermal print head pressure on the print media is automatically adjusted to an optimal TPH pressure for the detected print media thickness, resulting in better print registration and quality.

To load the printer 30, a ribbon roll leading edge may be pulled forward (arrow A in FIG. 2) along a ribbon path (arrow B in FIG. 2) above a stop sensor 46 of the print control assembly 36 and attached to the ribbon rewind spindle 44 (with, for example, tape on the empty ribbon take 15). The ribbon rewind spindle 44 is rotated until the ribbon overlaps the ribbon leading edge and stretches tight. The media roll 20 is inserted onto the media supply spindle 42 and threaded through the printer along a media path (arrow C in FIG. 2). The printer further comprises one or more motors (not shown) for rotating the ribbon supply spindle 40 and the ribbon roll disposed thereon in a forward or a backward rotational direction (dependent on the ink surface), for rotating the media supply spindle 42 and the media roll disposed thereon in a forward rotational direction, and for rotating the ribbon rewind spindle 44. The stop sensor 46 is communicatively coupled to the processor (CPU) 35. The stop sensor 46 detects the presence of the print media in the printer before the thermal print head 31 and outputs an analog signal 68 representing the presence or absence of print media. In the absence of print media, the stop sensor 46 outputs the analog signal referred to herein as a "no print media sensor signal".

The printer 30 further comprises a thermal print head 31 along the media path C utilized to thermally transfer a portion of ink from the ink ribbon to print media 22 as the ink ribbon is unwound from the ribbon core along the ribbon path B and the print media is unwound from the media core along the media path C. The printer 30 and control assembly 36 may have other components as known in the art.

Figure 4:
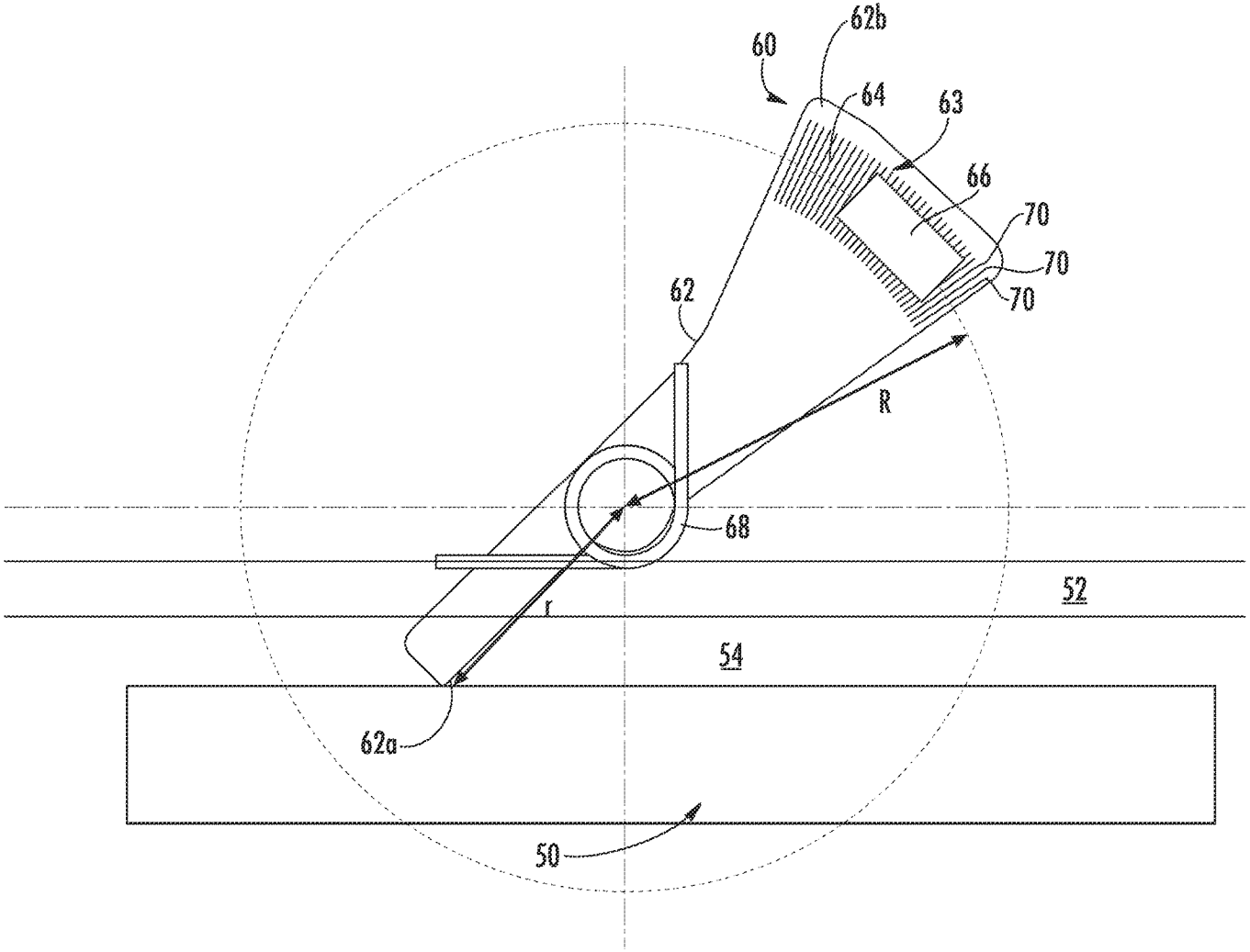
FIG. 4 schematically depicts in isolation components of the pinch arm assembly of FIG. 3, illustrating the pinch arm assembly located above the support base, the pinch arm of the pinch arm assembly having a length r and the encoder having a sensing radius R and the bracket and support base defining a channel along the media path C for print media to be fed into and passed therethrough on its way to the thermal print head of the exemplary printer of FIGS. 1 and 2, according to various embodiments.

Referring again to FIGS. 1 through 3, in accordance with various embodiments, the printer further comprises the thickness detection module 38 (encircled region in FIG. 1) 38 disposed along the media path, prior to (aft of) the thermal print head 31. The thickness detection module 38 includes a support base 50. As depicted in FIG. 4, the support base 50 and a bracket 52 above the support base define a channel 54 for feeding and passing print media therethrough on its way along the media path C to the thermal print head 31. The channel 54 is a portion of the media path. The bracket 52 serves as an upper media guide and the support base 50 serves as a lower media guide.

Referring now to FIGS. 3 through 6B, in accordance with various embodiments of the present invention, the thickness detection module 38 comprises a pinch arm assembly 60 (or simply "assembly") comprising a pinch arm 62 including an encoder 64 proximate a dual channel encoder sensor 66. The encoder 64 may be a round flat plate (i.e., an encoder disk) or a radius strip as shown. The dual channel encoder sensor 66 is communicatively coupled to the processor 35 of printer 30. The pinch arm assembly 60 further comprises a biasing element, such as a torsion spring 68 as depicted in FIGS. 3 through 6B. The torsion spring 68 is mounted on the bracket 52 disposed above the support base. As noted previously, the bracket and spaced-apart support base define the channel 54 that forms a portion of the media path C (FIG. 2). The biasing element as exemplified by the torsion spring 68 urges the pinch arm toward the support base and into engagement with at least a portion of the print media as hereinafter described.

The pinch arm 62 has a first end 62*a* and an opposite second end 62*b*, with the middle of the pinch arm being the pivot point. The first end 62*a* comprises a print media engagement end. The print media engagement end 62*a* engages with a top portion of at least a portion of the print media that is clamped between the print media engagement end and a top of the support base and disengages therefrom when the pinch arm is not engaged with at least a portion of the print media. The print media engagement end engages with the support base when there is no print media. The encoder 64 is disposed at the second end 62*b* of the pinch arm. The encoder 64 may be a separate component of the pinch arm assembly from the pinch arm and coupled to the second end 62*b* thereof or the encoder 64 may be integrally formed (one-piece) with the pinch arm 62. For example, the pinch arm 62 integrally formed with the encoder 64 has encoder markings as hereinafter described engraved into the second end of the pinch arm 62. In either case, rotation of the pinch arm comprises rotation of the encoder. The pinch arm has a length r (FIG. 4). The pinch arm extends radially from the support base, the pinch arm comprising an elongated substantially planar bar movably mounted on the bracket 52 for rotation with respect to the support base 50 as hereinafter described.

The encoder 64 is patterned with a single track of repeating identical lines 70 (i.e., "encoder markings") near an outside edge of the encoder (a series of circumferentially spaced lines and line pairs). The encoder has an encoder sensing radius R (FIG. 4). The lines 70 are dispersed radially about an axis of the encoder 64. The number of line pairs on the encoder 64 determines the encoder resolution (Cycles Per Revolution (CPR)), for example, the number of full quadrature cycles per revolution. A revolution comprises 360 mechanical degrees. The encoder resolution and thus the thickness detection resolution will increase as the CPR increases; however, printer stability is at risk if the CPR is too high. As hereinafter described, in accordance with various embodiments of the present invention, an encoder 64 with fine lines (greater than about 2000 Cycles Per Revolution (CPR)) may be used to detect print media thickness with sufficient resolution.

The dual channel encoder sensor 66 of the pinch assembly 60 detects and counts the line pairs as the lines of the encoder pass the dual channel encoder sensor 66 during rotation of the pinch arm and encoder as hereinafter described. The dual channel encoder sensor 66 of the pinch assembly 60 also detects rotation direction of the pinch arm and encoder. The number (n) of line pairs detected and counted over "a time interval" as the lines pass the dual channel encoder sensor during rotation of the pinch arm and encoder is used to determine an encoder count (i.e., the number of line pairs of the encoder that pass the dual channel encoder sensor during rotation of the pinch arm and encoder.) The encoder count is converted into a print media thickness using a conversion factor as hereinafter described. The time interval is the time in which the pinch arm and encoder rotate in one direction. As hereinafter described, the pinch arm and encoder change rotation direction when the print media thickness changes. Therefore, the encoder count is the number of line pairs that are counted until the print media thickness changes and the rotation direction reverses.

The dual channel encoder sensor detects and counts the line pairs of encoder lines 70 and rotation direction of the pinch arm and encoder as the first end of the pinch arm is engaged with the print media. The dual channel encoder sensor is configured to output at least one signal representing the rotation direction and the number of line pairs of the rotating encoder that pass the proximate dual channel encoder sensor during the time interval.

The encoder count is zero when there is no rotation of the pinch arm and encoder as the rotation is a result of displacement of the pinch arm by print media as hereinafter described. If there is no print media engaged by the pinch arm (more specifically, by the print media engagement end of the pinch arm), there is no rotation and the encoder count is zero.

Referring now to FIGS. 5A through 5B and 6A through 6B, according to various embodiments of the present invention, when the print media 22 travels along the media path (C in FIG. 2) on the way to the thermal print head 31, the print media 22 passes through the channel 54 between the support base 50 and the bracket 52. When a least a portion of the print media moves under the first end 62*a* of the pinch arm 62 disposed above the support base 50, the print media exerts a moving force on the pinch arm 62, with the help of the biasing element such as torsion spring 68, thereby displacing the pinch arm into engagement with at least the portion of the print media. The pinch arm 62 is displaced at a different angle of rotation as reflected in the encoder count depending upon the print media thickness. The pinch arm 62 is displaced at a greater angle of rotation (a higher encoder count) as the print media thickness increases. The biasing element, such as torsion spring 68, presses the first end of the pinch arm as low as possible before the print media is fed through the channel 54. Once the print media is fed through the channel 54, the pinch arm rotates a certain amount and the amount of rotation translates to the print media thickness. The encoder count is therefore the difference in encoder counts before and after feeding the print media through the channel.

Figure 5B:
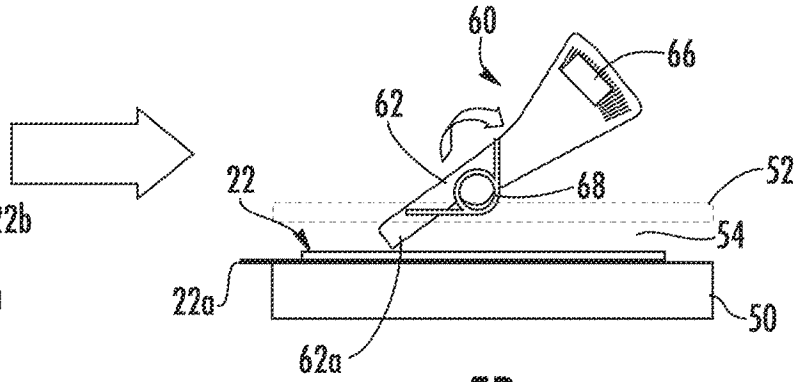
FIGS. 5A and 5B depict clockwise rotation of the pinch arm and encoder from a first position (FIG. 5A) in which the print media engagement end of the pinch arm is engaged with a liner only portion of the print media (i.e., "thin" print media) passing through the channel between the support base and the bracket of the thickness detection module (FIGS. 1 and 2) to a second position in which the print media engagement end of the pinch arm is engaged with "thick print media" comprising a print medium portion and an underlying liner portion) with a corresponding increase in encoder count (not shown in FIGS. 5A and 5B; see FIG. 7B), according to various embodiments (a so-called "thin to thick embodiment")
Figure 5A:
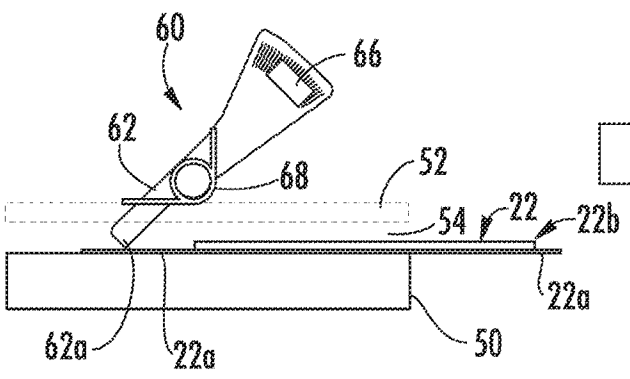

FIGS. 5A and 5B, according to various embodiments of the present invention, depict clockwise rotation of the pinch arm from a first position (FIG. 5A) in which the print media engagement end (the first end 62*a*) of the pinch arm is engaged with the liner only portion 22*a*-1 (FIG. 7A) of the print media 22 (i.e., "thin" print media) passing through the channel 54 between the support base and the bracket of the thickness detection module (FIGS. 1 and 2) to a second position in which the print media engagement end (first end 62*a*) of the pinch arm is engaged with a thicker portion of the print media (the print medium portion 22*b* and an underlying liner portion 22*a*) ("thick" print media) (FIG. 7A) (a so-called "thin to thick embodiment"). The print media 22 passes through the channel toward the thermal print head 31.

Figure 6B:
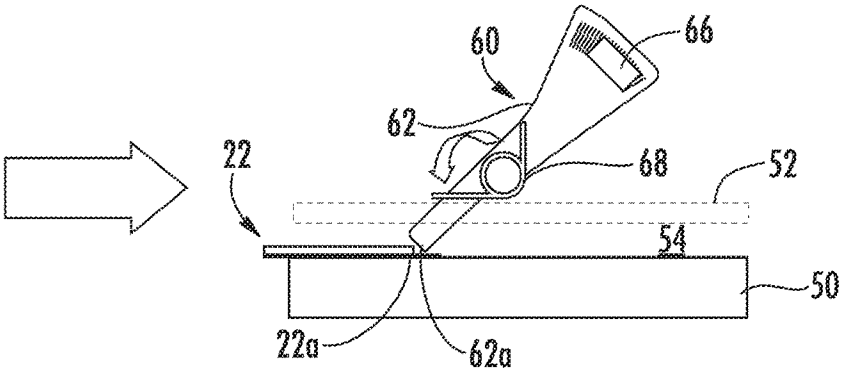
FIGS. 6A and 6B graphically depicts counterclockwise movement of the pinch arm from a first position (FIG. 6A) in which the first end of the pinch arm is engaged with the thick print media (the print medium portion and an underlying liner portion) passing through the channel such as in FIG. 5B to a second position in which the first end of the print media is engaged with the liner only portion of the print media (i.e., the thin print media) (a so-called "thick to thin embodiment") with a corresponding decrease in encoder count (not shown in FIGS. 6A and 6B; see FIG. 7B), the rotational direction of the pinch arm and encoder different depending upon whether the print media thickness increases (thin to thick) or decreases (thick to thin) according to various embodiments.
Figure 6A:
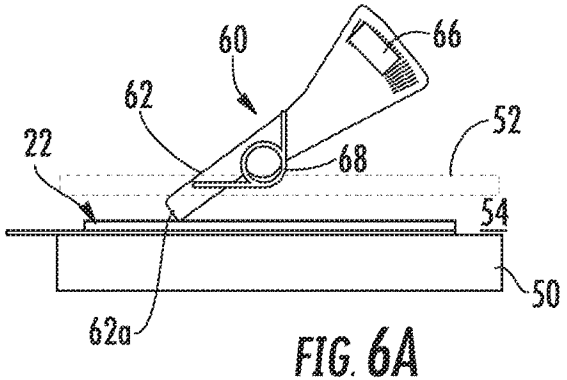

In accordance with various embodiments, FIGS. 6A and 6B graphically depict counterclockwise rotation of the pinch arm from a first position (FIG. 6A) in which the first end of the pinch arm is engaged with the thick print media (the print medium portion and an underlying liner portion) passing through the channel to a second position in which the first end of the print media is engaged with the liner only portion of the print media (i.e., thin print media), with the encoder count decreasing as the print media thickness decreases and the rotation direction of the pinch arm changing in response to a change in the print media thickness according to various embodiments (a so-called "thick to thin embodiment"). The print media 22 passes through the channel along the media path (C in FIG. 2) toward the thermal print head 31. Thus, the dual channel encoder sensor detects the relative movement of the pinch arm and encoder before and after the print media is loaded into the printer.

Figure 7B:
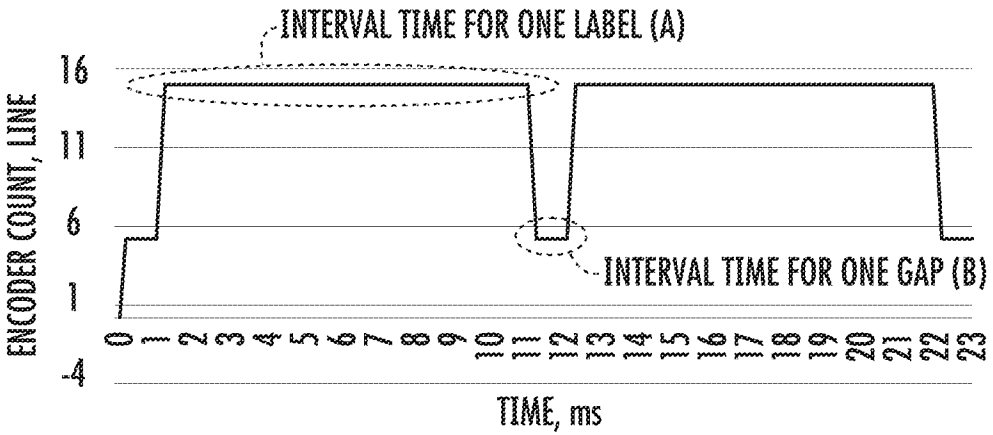

Still referring to FIGS. 5A through 5B and 6A through 6B, and now to FIGS. 7A and 7B, according to various embodiments of the present invention, the encoder count and the rotation direction changes as the print media thickness changes. The encoder count is lower (5 in the depicted embodiment) when the first end of the pinch arm is engaged with the liner only (thin) portion 22*a*/22*a*-1 of the print media (FIGS. 5A and 6B). As shown in FIG. 7B, the first end of the pinch arm is engaged with the liner only portion of the print media for one milliseconds (ms) (the "time interval"). The encoder count is higher (15 in the depicted embodiment) when the first end of the pinch arm is engaged with the thicker print media 22 (inclusive of liner portion 22*a* and print media portion 22*b*) (FIGS. 5B and 6A). As shown in FIG. 7B, the first end of the pinch arm is engaged with the thicker print media (encoder count at highest value) for an exemplary 10 milliseconds (ms) (a "time interval").

According to various embodiments, the length of the label, as well as the gap length and pitch between labels can be determined using the method according to various embodiments. The velocity (print speed) of the moving label is known by the printer. The time interval (e.g., 10 milliseconds in the depicted embodiment of FIG. 7B) in which the first end of the pinch arm is engaged with the thicker print media is an interval time for one label (encircled region A in FIG. 7B). The gap length between labels is depicted as encircled region B in FIG. 7B as "Interval Time for one gap" which is the interval time of encoder count at the lowest value. According to various embodiments:

Label length=Interval time for one label×velocity;

Gap length between labels=Interval time for one gap×velocity;

Label pitch=Label length+Gap length.

Figure 8:
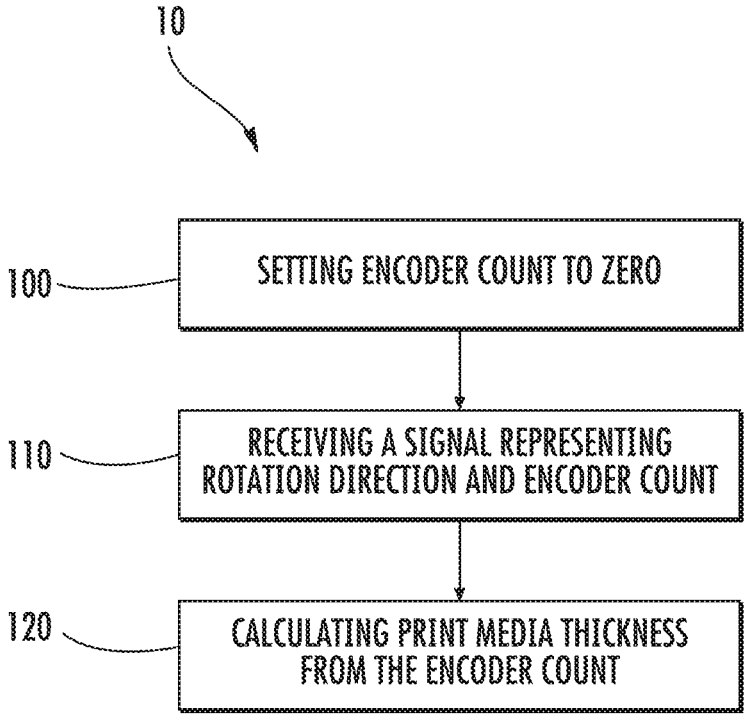
FIG. 8 is a flow diagram of a method for detecting print media thickness of print media in a printer, according to various embodiments.

Referring now to FIG. 8, according to various embodiments, a method 10 for detecting a print media thickness of the print media in a printer comprises setting the encoder count to zero (step 100). Prior to setting the encoder count to zero, the user may be prompted to remove the print media from the printer. The processor sets the encoder count to zero when the processor 35 receives a stop sensor signal from the stop sensor (46 in FIG. 2) that no print media is present, i.e., receives a no print media sensor signal.

Still referring to FIG. 8, according to various embodiments, the method 10 for detecting the print media thickness comprises receiving a signal from the dual channel encoder sensor, the signal representing the rotation direction and the number of line pairs that, during the time interval, pass by the dual channel encoder sensor as the pinch arm and encoder rotate (i.e., the encoder count) (step 110). The thickness of the print media is detected by counting the relative movement of the pinch arm before and after the print media is inserted into the printer. As noted previously, the encoder count is set to zero before feeding the print media into the channel. As the print media 22 passes through the channel in the thickness detection module, and more specifically between the first end of the pinch arm and the support base, the pinch arm rotates at a different angle of rotation depending upon the print media thickness. The encoder count also differs depending upon the print media thickness, i.e., the number of encoder line pairs that pass the dual channel encoder sensor differs depending upon the print media thickness. As the print media thickness increases, the encoder count increases. As the print media thickness decreases, the encoder count decreases. Thus, if the first end of the pinch arm engages with the liner only portion of the print media (for example, in the gap between (thicker) individual medium), the encoder count will be less than the encoder count when the first end of the pinch arm engages with the thicker portion of the print medium (e.g., a label and the underlying liner).

The accuracy of the calculated print media thickness depends upon the encoder sensing radius R/pinch arm length r ratio (FIG. 4) and the encoder CPR. The accuracy may be increased by increasing the ratio and/or by increasing the CPR number of the encoder. For example, a 0.1 mm resolution may be achieved with a 2000 CPR encoder. A 0.05 mm resolution and a 0.02 mm resolution may be achieved with a 5000 CPR encoder. However, increasing the thickness detection resolution too much may increase sensitivity of the printer toward jerk and vibration. Therefore, increasing the accuracy of the calculated print media thickness requires a balance between resolution improvement and printer stability.

Still referring to FIG. 8, according to various embodiments of the present invention, the method 10 for detecting a print media thickness of the print media comprises, in response to receiving the at least one signal from the dual channel encoder sensor, calculating the print media thickness from the encoder count by using the conversion factor (step 120). As noted previously, the conversion factor is used by the processor 35 to calculate the print media thickness from the encoder count. For the conversion of the exemplary encoder counts depicted in FIG. 7B, the exemplary conversion factor comprises an encoder count of 5 being equal to a print media thickness of 0.1 mm as noted previously. Of course, the conversion factor may be other than this and may be determined by encoder resolution, i.e., by the pinch arm length r and encoder sensing radius R.

Therefore, as described previously, in the example provided in FIGS. 5A through 5B and FIGS. 6A through 6B, the encoder count changes from zero (no print media between the first end of the pinch arm and the support base), to an encoder count of 5 when the liner only portion 22*a*/22*a*-1 is engaged between the first end of the pinch arm and the support base (i.e., FIGS. 5A and 6B), to an encoder count of 15 when the print media 22 (inclusive of the liner portion 22*a* underlying the individual print medium portion (e.g., a label) is engaged between the first end of the pinch arm and the support base (FIGS. 5B and 6A). Using the exemplary conversion factor as discussed above, the processor 35 calculates from the encoder count of 5 (FIG. 7B) that the liner portion of the print media has a 0.1 mm liner thickness (an exemplary print media thickness) and from the encoder count of 15 that the print media comprising the liner portion underlying the print medium portion is 0.3 mm thick (an exemplary print media thickness). The processor may calculate the print medium portion thickness by subtracting the liner thickness from the total thickness, making the label 0.2 mm thick (0.3 mm-0.1 mm) in the depicted embodiment of FIG. 7A.

Once the print media thickness is calculated, the TPH pressure may be adjusted to the optimal TPH pressure for the calculated print media thickness (the print job), resulting in better print registration and print quality. The TPH pressure is adjusted in a well-known manner (i.e., Firmware control motor system may be used to change TPH pressure).

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696;

U.S. Pat. No. 8,842,849; U.S. Pat. No. 8,844,822;
U.S. Pat. No. 8,844,823; U.S. Pat. No. 8,849,019;
U.S. Pat. No. 8,851,383; U.S. Pat. No. 8,854,633;
U.S. Pat. No. 8,866,963; U.S. Pat. No. 8,868,421;
U.S. Pat. No. 8,868,519; U.S. Pat. No. 8,868,802;
U.S. Pat. No. 8,868,803; U.S. Pat. No. 8,870,074;
U.S. Pat. No. 8,879,639; U.S. Pat. No. 8,880,426;
U.S. Pat. No. 8,881,983; U.S. Pat. No. 8,881,987;
U.S. Pat. No. 8,903,172; U.S. Pat. No. 8,908,995;
U.S. Pat. No. 8,910,870; U.S. Pat. No. 8,910,875;
U.S. Pat. No. 8,914,290; U.S. Pat. No. 8,914,788;
U.S. Pat. No. 8,915,439; U.S. Pat. No. 8,915,444;
U.S. Pat. No. 8,916,789; U.S. Pat. No. 8,918,250;
U.S. Pat. No. 8,918,564; U.S. Pat. No. 8,925,818;
U.S. Pat. No. 8,939,374; U.S. Pat. No. 8,942,480;
U.S. Pat. No. 8,944,313; U.S. Pat. No. 8,944,327;
U.S. Pat. No. 8,944,332; U.S. Pat. No. 8,950,678;
U.S. Pat. No. 8,967,468; U.S. Pat. No. 8,971,346;
U.S. Pat. No. 8,976,030; U.S. Pat. No. 8,976,368;
U.S. Pat. No. 8,978,981; U.S. Pat. No. 8,978,983;
U.S. Pat. No. 8,978,984; U.S. Pat. No. 8,985,456;
U.S. Pat. No. 8,985,457; U.S. Pat. No. 8,985,459;
U.S. Pat. No. 8,985,461; U.S. Pat. No. 8,988,578;
U.S. Pat. No. 8,988,590; U.S. Pat. No. 8,991,704;
U.S. Pat. No. 8,996,194; U.S. Pat. No. 8,996,384;
U.S. Pat. No. 9,002,641; U.S. Pat. No. 9,007,368;
U.S. Pat. No. 9,010,641; U.S. Pat. No. 9,015,513;
U.S. Pat. No. 9,016,576; U.S. Pat. No. 9,022,288;
U.S. Pat. No. 9,030,964; U.S. Pat. No. 9,033,240;
U.S. Pat. No. 9,033,242; U.S. Pat. No. 9,036,054;
U.S. Pat. No. 9,037,344; U.S. Pat. No. 9,038,911;
U.S. Pat. No. 9,038,915; U.S. Pat. No. 9,047,098;
U.S. Pat. No. 9,047,359; U.S. Pat. No. 9,047,420;
U.S. Pat. No. 9,047,525; U.S. Pat. No. 9,047,531;
U.S. Pat. No. 9,053,055; U.S. Pat. No. 9,053,378;
U.S. Pat. No. 9,053,380; U.S. Pat. No. 9,058,526;
U.S. Pat. No. 9,064,165; U.S. Pat. No. 9,064,167;
U.S. Pat. No. 9,064,168; U.S. Pat. No. 9,064,254;
U.S. Pat. No. 9,066,032; U.S. Pat. No. 9,070,032;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;

U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;
U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTI-FUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

In the specification and/or figures, various embodiments of the present invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A printer comprising:

a thickness detection module comprising:

a pinch arm assembly comprising:

a pinch arm having a first end and a second end;

an encoder disposed at the second end of the pinch arm, the encoder configured to rotate in response to engagement of the pinch arm with at least a portion of the print media;

a dual channel encoder sensor proximate the encoder and configured to detect a rotation direction and an encoder count indicative of rotation movement of the encoder with respect to the dual channel encoder; and a processor communicatively coupled to the thickness detection module to calculate a print media thickness of the portion of the print media based on the encoder count and adjust a print head pressure based on the calculated print media thickness.

2. The printer according to claim 1, wherein:

the processor calculates the print media thickness from the encoder count using a conversion factor; and the conversion factor is one of a predetermined value and a value computed using the encoder resolution.

3. The printer according to claim 1, wherein the encoder count comprises a number of circumferentially spaced line pairs on the encoder that pass by the dual channel encoder sensor as the pinch arm and encoder rotates.

4. The printer according to claim 1, wherein the rotation direction changes each time the print media thickness changes, the rotation direction comprising a first rotation direction and a second rotation direction, the pinch arm and encoder rotating in the first rotation direction in response to an increase in the print media thickness and in the opposite second rotation direction in response to a decrease in the print media thickness.

5. The printer according to claim 4, wherein the encoder count increases with rotation in the first rotation direction and the encoder count decreases with rotation in the opposite second rotation direction.

6. The printer according to claim 5, wherein the pinch arm and encoder are configured to rotate in the first rotation direction in response to engagement with at least the portion of the print media comprising a print medium portion overlying a liner portion and in the opposite second rotation direction in response to engagement with at least the portion of the print media comprising a liner only portion, the encoder count from rotation in the first rotation direction comprising a first encoder count and the encoder count from rotation in the second rotation direction comprising a second encoder count that is less than the first encoder count.

7. The printer according to claim 6, wherein the print media thickness of the print medium portion overlying the liner portion is calculated from the first encoder count and the print media thickness of the liner only portion of the print media is calculated from the second encoder count, a thickness of the print medium calculated by subtracting print media thickness calculated from the second encoder count from the print media thickness calculated from the first encoder count.

8. The printer according to claim 1, wherein the first end of the pinch arm comprises a print media engagement end that engages with a top portion of at least the portion of the print media that is clamped between the print media engagement end and a top of a support base and that disengages therefrom when the pinch arm is not engaged with at least the portion of the print media.

9. The printer according to claim 8, wherein the pinch arm extends radially from a media guide, the pinch arm comprising an elongated substantially planar bar movably mounted on the media guide for rotation with respect to the media guide.

10. The printer according to claim 1, wherein the pinch arm assembly comprises a biasing element for biasing the pinch arm toward a support base and into engagement with at least the portion of the print media.

11. The printer according to claim 10, comprising a bracket above the support base for mounting of the biasing element, wherein a media roll disposed on a media supply spindle of the printer is configured to rotate in a predetermined direction to have the print media thereof fed into and passed through a channel defined between the bracket and the support base.

12. The printer according to claim 1, wherein the thickness detection module is located in the printer along a media path prior to a thermal print head utilized to thermally transfer a portion of ink from an ink ribbon in a ribbon roll to the print media with a thermal print head (TPH) pressure that is automatically adjusted for the calculated print media thickness.

13. The printer according to claim 1, comprising a stop sensor communicatively coupled to the processor to indicate the presence of a print media in the printer.

14. A method for detecting the thickness of print media in a printer, the method comprising:

setting an encoder count to zero in response to receiving a no print media sensor signal;

receiving a signal from a dual channel encoder sensor proximate an encoder disposed at an end of a pinch arm, the signal representing a rotation direction and an encoder count as the encoder rotates in the rotation direction and passes by the dual channel encoder sensor;

calculating a print media thickness of the print media based on the encoder count; and adjusting the print head pressure based on the calculated print media thickness.

15. The method according to claim 14, wherein the encoder count comprises a number of circumferentially spaced line pairs on the encoder that, during a time interval, pass by the dual channel encoder sensor as the pinch arm and encoder rotate in the rotation direction.

16. The method according to claim 14, wherein receiving the signal comprises receiving a first signal representing a first rotation direction and a first encoder count, and in response to receiving the first signal, calculating the print media thickness of a portion of the print media from the first encoder count.

17. The method according to claim 16, wherein receiving the signal comprises receiving a second signal representing an opposite second rotation direction and a second encoder count, as the pinch arm and encoder rotate in the second rotation direction, and in response to receiving the second signal, calculating the print media thickness of a different portion of the print media from the second encoder count.

18. An assembly configured to detect a print media thickness in a printer, the assembly comprising:

a pinch arm having a first end and a second end;

an encoder disposed at the second end of the pinch arm, the encoder configured to rotate in response to engagement of the pinch arm with at least a portion of the print media;

a dual channel encoder sensor proximate the encoder and configured to detect a rotation direction and an encoder count indicative of rotation movement of the encoder in a single rotational direction with respect to the dual channel encoder; and a biasing element for urging the pinch arm into engagement with at least the portion of the print media.

19. The assembly according to claim 18, wherein the encoder comprises of a number of circumferentially spaced line pairs, the pinch arm and encoder configured to rotate in response to engagement of the pinch arm with at least the portion of the print media.

* * * * *